US012797757B2

(12) United States Patent
Koide

(10) Patent No.: US 12,797,757 B2
(45) Date of Patent: Nov. 17, 2026

(54) WATER ATTRACTION RIDE SURFACE AND METHODS

(71) Applicant: WHITEWATER WEST INDUSTRIES LTD., Richmond (CA)

(72) Inventor: Brad Koide, San Diego, CA (US)

(73) Assignee: WHITEWATER WEST INDUSTRIES LTD. (CA)

( * ) Notice: Subject to any disclaimer, the term of this patent is extended or adjusted under 35 U.S.C. 154(b) by 955 days.

(21) Appl. No.: 17/650,003

(22) PCT Filed: Aug. 5, 2020

(86) PCT No.: PCT/US2020/045075

§ 371 (c)(1),
(2) Date: Aug. 16, 2023

(87) PCT Pub. No.: WO2021/026279

PCT Pub. Date: Feb. 11, 2021

(65) Prior Publication Data

US 2024/0316471 A1 Sep. 26, 2024

Related U.S. Application Data

(60) Provisional application No. 62/882,610, filed on Aug. 5, 2019, provisional application No. 62/885,195, filed on Aug. 9, 2019.

(51) Int. Cl.
*A63G 31/00* (2006.01)
*A63B 69/00* (2006.01)
(Continued)

(52) U.S. Cl.
CPC ..... *A63G 31/007* (2013.01); *A63B 69/0093* (2013.01); *A63G 21/18* (2013.01); *A63G 31/12* (2013.01); *A63B 2209/10* (2013.01)

(58) Field of Classification Search
CPC .. A63G 21/18; A63G 31/007; A63B 69/0093; A63B 2209/10
See application file for complete search history.

(56) References Cited

U.S. PATENT DOCUMENTS 5,628,584 A 5/1997 Lochtefeld
6,491,589 B1 12/2002 Lochtefeld
(Continued)

FOREIGN PATENT DOCUMENTS

CA 2948566 C 1/2024
CN 107715458 A 2/2018
(Continued)

OTHER PUBLICATIONS

First Office Action for CN Application No. 202080069510.8, dated Jan. 21, 2025, 19 pages.
(Continued)

*Primary Examiner* — Audrey B. Walter
(74) *Attorney, Agent, or Firm* — Pillsbury Winthrop Shaw Pittman LLP

(57) ABSTRACT

A water ride apparatus is shown and described including a tensioned layer supporting an inflatable layer. The combination of the tensioned layer and inflatable layer showing surprisingly improved impact resistance and performance characteristics for a ride surface.

20 Claims, 5 Drawing Sheets

(51) Int. Cl.
*A63G 21/18* (2006.01)
*A63G 31/12* (2006.01)

(56) References Cited

U.S. PATENT DOCUMENTS

| | | | | |
|---|---|---|---|---|
| 6,676,530 | B2 | 1/2004 | Lochtefeld | |
| 9,463,390 | B2 | 10/2016 | Vicente | |
| 9,795,890 | B1 | 10/2017 | Bradshaw | |
| 2005/0148398 | A1 | 7/2005 | Lochtefeld | |
| 2008/0216427 | A1 | 9/2008 | Lochtefeld | |
| 2013/0130815 | A1* | 5/2013 | Lochtefeld | A63G 31/16 472/128 |
| 2014/0357387 | A1 | 12/2014 | Murphy | |
| 2015/0057093 | A1 | 2/2015 | Murphy | |
| 2015/0273353 | A1 | 10/2015 | Coleman | |
| 2016/0199744 | A1 | 7/2016 | McCarthy | |
| 2017/0136371 | A1 | 5/2017 | Vicente et al. | |
| 2017/0136372 | A1* | 5/2017 | Koide | A63B 69/0093 |
| 2017/0136373 | A1 | 5/2017 | Vicente | |
| 2019/0046887 | A1 | 2/2019 | Vicente et al. | |

FOREIGN PATENT DOCUMENTS

| | | | | | |
|---|---|---|---|---|---|
| CN | 108159708 | A | | 6/2018 | |
| CN | 207805037 | U | | 9/2018 | |
| KR | 20160136977 | A | * | 11/2016 | A63G 21/00 |
| WO | 2015025298 | A1 | | 2/2015 | |

OTHER PUBLICATIONS

Office Action for AE Application No. P6000224/2022, dated Dec. 17, 2024, 7 pages.

Supplementary European Search Report for European Application No. EP20200849943, mailed Jul. 4, 2023, 09 Pages.

International Preliminary Report on Patentability for International Application No. PCT/US2020/045075, dated Feb. 17, 2022, 9 pages.

International Search Report and Written Opinion for International Application No. PCT/US2020/045075, dated Nov. 4, 2020, 11 pages.

* cited by examiner

WATER ATTRACTION RIDE SURFACE AND METHODS

CROSS-REFERENCE

This application is a national stage filing of PCT application PCT/US20/45075 filed Aug. 5, 2020 and claims the benefit of U.S. Provisional Applications No. 62/885,195 filed Aug. 9, 2019, and 62/882,610 filed Aug. 5, 2019, both entitled ATTRACTION RIDE SURFACE which applications are incorporated herein in its entirety by reference.

BACKGROUND

There are many simulation rides that provide an adventurous experience in a confined space or at a geographic location not naturally suited for the activity. For example, there are water attractions that simulate the surfing experience in many ways that are available in locations far from an ocean front or that provide more controlled environmental conditions than actual surf.

A type of surf simulation ride device includes sheet-flow wave simulating water rides. These rides typically include a sloped ride surface the supports a rider over a thin sheet of water. The water flows from an outlet across the sloped ride surface and spills into a drainage area before being recirculated back to the outlet onto the ride surface. Riders are able to ride and perform surfing actions on the thin sheet of water cascading across the ride surface with either their bodies or on a board.

Because only a thin sheet of water exists between the rider and the ride surface, if a rider falls, the rider impacts the underlying surface quickly. A fall during the riding experience can cause substantial injuries when a rider impacts the underlying surface at a high force. Conventional systems have attempted to improve rider safety from impact injuries by reducing the potential impact forces on a rider when they fall. However, reducing the impact force for a rider typically involves increasing the flexibility of the ride surface. Increasing the flexibility of the ride surface can, unfortunately, negatively affect the ride experience for the rider because the ride surface supports the forces of the injected water upon the ride surface and impacts the shape of the ride surf generated by the surf simulation ride device. It is therefore difficult to substantially improve rider safety during an impact while maintaining the integrity of the surf experience.

What is needed is a surf-simulation ride apparatus or device, or water ride apparatus, that improves safety for a rider during use without adversely affecting the ride experience.

SUMMARY

Disclosed is a water ride apparatus that improves safety for a water ride attraction rider during use without adversely affecting the ride experience for the rider. The water ride apparatus is shown and described herein comprising a tensioned layer and an inflatable layer. The tensioned layer may be a tensioned surface. The inflatable layer may be positioned on top of the tensioned layer and coupled thereto.

The ride surface of the water ride apparatus comprises at least a tensioned layer and an inflatable layer. The inflatable layer can be drop-stitch constructed and positioned on an upper surface of the tensioned layer. The inflatable layer can have, for example, four or more separate chambers integrated together by a top sheet. The top sheet can be provided to provide a unitary construction of the inflatable layer. Additionally, the tensioned layer and the inflatable layer can be secured. In some configurations, a cover is provided that extends forward from an edge of the inflatable layer. The cover can provide a loop and/or thread through a bar. The inflatable layer can also, in some configurations, be pinned along one or more sides to an inflatable wall and/or tied down through apertures in a water recovery/drainage system.

INCORPORATION BY REFERENCE

All publications, patents, and patent applications mentioned in this specification are herein incorporated by reference to the same extent as if each individual publication, patent, or patent application was specifically and individually indicated to be incorporated by reference.

U.S. Pat. No. 5,628,584 issued May 13, 1997, to Lochtefeld for Method and apparatus for containerless sheet flow water rides;

U.S. Pat. No. 6,491,589 issued Dec. 10, 2002, to Lochtefeld for Mobile water ride having slide slide-over cover;

U.S. Pat. No. 6,676,530 issued Jan. 13, 2004, to Lochtefeld for Contoured variably tensionable soft membrane ride surface for ride attraction;

U.S. Pat. No. 9,463,390 issued Oct. 11, 2016 to Vicente for Inflatable surfing apparatus and method; and U.S. Publication No. 2017/0136373 A1 published May 18, 2017 to Vicente et al. for Inflatable surfing apparatus and method.

DRAWINGS

DESCRIPTION

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Exemplary embodiments described herein are directed at ride surface configurations used for amusement park water ride apparatuses. Although embodiments of the invention may be described and illustrated herein in terms of water ride apparatus, it should be understood that embodiments of this invention are not so limited, but are additionally applicable to other rider experiences in which a ride surface may pose an injury risk to a user from falling or otherwise impacting the surface.

Figure 1:
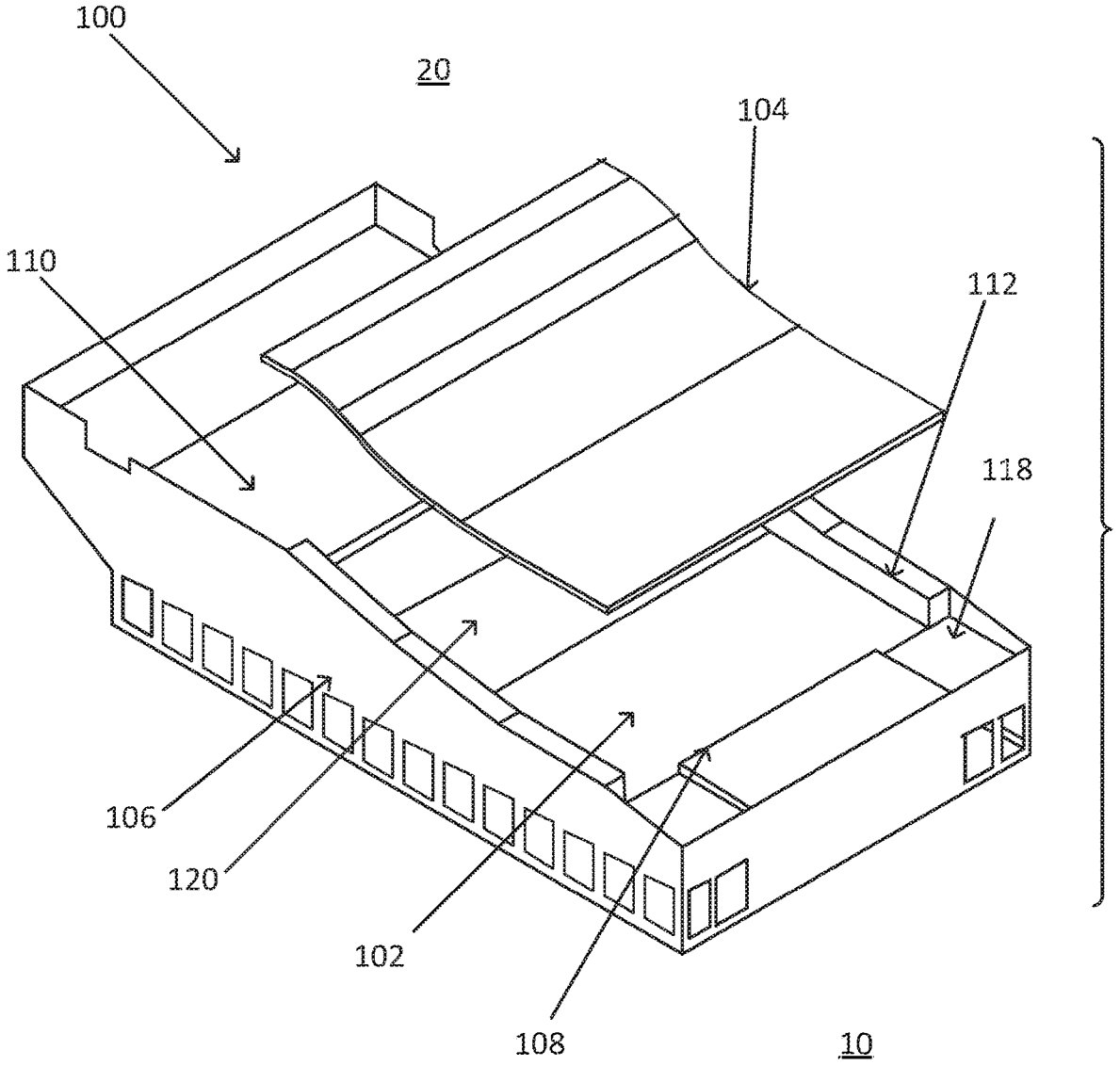
FIG. 1 illustrates an exemplary water ride apparatus in which components parts are separated for sake of illustration according to embodiments described herein.

FIG. 1 illustrates a perspective exploded view of an exemplary water ride apparatus 100 from a front end 10 according to embodiments described herein. As shown, a base or support structure 106 is provided. The base or support structure 106 may support a system for injecting water onto a ride surface. Water can be injected onto the surface so that the water achieves a sheet flow on the upper surface of the ride surface. Sheet flows of water can provide a conforming flow that follows the contours of the ride surface below the sheet flow.

The water ride apparatus 100 can be configured to include suitable flow source components for the water, for example one or more of any of, piping, pumps, fast moving streams, elevated reservoirs, etc. Water can also be passed through a filter mechanism or UV treatment system prior to reuse. A suitable power supply can also be provided to operate the pump or any sensors associated with the water ride apparatus 100. In some configurations, the water ride apparatus 100 may include a water injection system at a front end 10 configured to inject water onto the ride surface 110 and a water collection system (e.g., drainage area 118) at a front end 10. The injection system may include one or more nozzles 108 at the front end 10 of the water ride apparatus 100.

The water removal or drainage area 118 provided at the front end 10 of the water ride apparatus 100 provides a drainage mechanism which can be used to recycle the water to the water injection system 108. The water removal or drainage area 118 provided at the back end 20 of the water ride apparatus 100 provides a drainage mechanism for a majority of the water as the water traverses across the ride surface from the front of the ride attraction 10 to the back of the ride attraction 20. The water can drain through the water recover surface 118, while supporting a rider thereon. For example, a rider may leave or start the ride from the back of the ride and stand on the drainage area 118, while permitting water to pass there through and minimize the effect of the water flow from the ride surface. The drainage area of the back of the ride can be used to recycle the water to the water injection system 108. The base or support structure 106 may also support the ride surface, i.e., be positioned below at least a portion of the ride surface as illustrated. The drainage area 118 may include apertures for passing water. The apertures may be created by a grid or other support surface to pass water there through.

The base 106 may define an interior fluid reservoir (not shown) for holding and/or processing water from the ride surface 110. Alternatively, the base 106 may be positioned around, in, and/or over (e.g., enclose) a separate fluid reservoir container. The fluid reservoir can be configured to recirculate water after the water passes from a back end 20 of the ride surface to a front end 10) of the ride surface.

In another embodiment, the base 106, or the base 106 and separate fluid reservoir, may fit partially or completely within another structure, such as a concrete cavity. When the base 106 is positioned partially or completely within a concrete cavity, the base 106 can support the ride surface and be positioned on, around, through, and/or over the fluid reservoir created or positioned within the concrete cavity.

The ride surface can comprise a plurality of ride surface layers integrally formed to operate as ride surface for the water ride apparatus 100. The ride surface layers include: first ride surface layer (tensioned layer 102), and second ride surface layer (inflatable layer 104), positioned adjacent of the first ride surface. Other layers or shape elements can be provided that are positioned adjacent or between the first ride surface layer and the second ride surface layer without departing from the scope of the disclosure. Each layer of the ride surface has an upper layer and a lower layer. The tensioned layer 102 can be fabricated from a reinforced membrane material tensioned over a supporting framework. The inflatable layer 104 may be fabricated by, for example, drop-stitch manufactured panels.

The ride surface can be extended, shortened, symmetrical, asymmetrical, planar or comprised of complex curved surfaces. Additionally, the depth or velocity of the flow can be varied from one rider to another without departing from the scope of the disclosure.

In an exemplary embodiment, the ride surface of the water ride apparatus 100 includes a tensioned layer 102 and an inflatable layer 104. The tensioned layer 102 is positioned below the inflatable layer 104 and provides support to all or most of the inflatable layer 104. The inflatable layer 104 may be separate from, positioned over at least a portion of, and/or supported by at least a portion of the tensioned layer 102. The ride surface is configured to support a sheet of water cascading down an upper surface of the ride surface during use, with a user (not shown) positioned thereon.

As noted above, the tensioned layer 102 may be a tensioned material supported by a tension framework. The water ride apparatus 100 may also include a support structure 106 which is a framework for the tensioned layer 102. The support structure 106 can provide one or more beams (shown in FIG. 7 as beams 706-A, 706-B) which are configured to couple to the tensioned layer 102 and impose a tension onto the tensioned layer, such that the tensioned layer 102 is maintained under tension. The tensioned layer 102 can provide the support and shape characteristics for the ride surface. The membrane material of the tensioned layer 102 may be made of a substantially continuous sheet of fabric and/or plastic and/or other strong, pliable sheet material. The tensioned layer 102 is tensioned at its edges to provide the desired rigidity to support the rider and the injected flow of water. The support may include tensioning elements to attach and impose a tension force to the tension layer 102.

The ride surface shape can be impacted by or defined by one or more of the support structure 106, the tension layer 102 and the inflatable layer 104. For example, as illustrated, the tensioned layer 102 may include one or more sections defining one or more different horizontal and/or sloped surface of varying degree defined by the support structure 106 shape. The one or more sloped surface of the tensioned layer 102 may create an incline that, when covered with water, creates a ridable water layer. The support structure 106 may also provide a support base to elevate the ride surface over a reservoir for recirculating water from the water collection system to the water injection system. Additionally, an amount of tension applied to the tensioned layer 102 can dynamically change how the tensioned layer 102 curves at different points of time during use.

The inflatable layer 104 may be adjacent or over the tensioned layer 102. The inflatable layer 104 may also contact the tensioned layer 102. One or more additional inflatable bladders may also be provided to further deform the ride surface and create desired variations of the ride surface.

The inflatable layer 104 may also have varying thickness, either of the entire layer or of the material forming the layer, to alter the ride surface shape created by the tensioned layer 102. When the inflatable layer 104 has a constant thickness, the ride surface shape generally created by the tensioned layer 102 is also achieved by the inflatable layer 104 so that the ride shape of the inflatable layer 104 approximates the ride shape defined by the tensioned layer 102, e.g., conforms or substantially conforms to the shape of the tensioned layer 102. In an exemplary embodiment, the inflatable layer 104 is approximately 50 mm to 100 mm. The inflatable layer 104 may also be formed from a drop stitch construction. The inflatable layer 104 may also be coupled to an inflation system configured to refill the inflatable layer 104 as the layer looses gas. The inflation system may be configured to inflate the inflatable layer 104 to a pressure of from 8-10 psi (pounds per square inch).

A ride surface incline may be positioned from an area proximate or adjacent to the water injection area or a horizontal ride surface area. The incline may be from a position of lower elevation to a position of higher elevation. The incline may be also used to create or define the ride experience.

The support structure 106 may also include lateral sides that define outer walls on the sides of the ride surface. The lateral sides can either be a cushioned wall 112 or be configured to include a cushioned wall 112. The cushioned wall 112 may be an inflatable wall or may be configured to form an impact absorbing surface from an impact absorbing material, such as foam.

An additional top layer may be added to the riding surface. The top layer may include a reduced friction surface to further improve rider maneuverability on the ride surface. The top layer may also be a coating applied directly on the inflatable layer 104. In an exemplary embodiment, the inflatable layer 104 is created by more than one separately inflatable bladder. The separately inflatable bladders may be positioned adjacent each other such that the plurality of separately inflatable bladders traverse across the tensioned layer 102. When a top layer is provided, the top layer may extend across and coupled to the plurality of separately inflatable bladders to create a unitary inflatable layer system. The additional top layer may also be configured to create a more continuous upper surface providing a transition between the surface of one inflatable bladder to an adjacent inflatable bladder. The top layer may also fully enclose the separately inflatable bladder to cover a top of the separately inflatable bladder, sides of the exterior bladders, and/or bottom of the separately inflatable bladders.

Additional bladders may be incorporated to alter the ride surface shape at specific locations along the ride surface. For example, additional bladders may be positioned under the tensioned layer 102 and/or between the tensioned layer 102 and the inflatable layer 104 and/or between the inflatable layer 104 and a top layer. The additional bladders may be independently inflated to locally alter a contour of the ride surface over or around the additional bladder.

A wave shape is created by a high velocity sheet flow of water over a contoured ride surface. The ride surface includes ride surface incline 120. The ride surface incline 120 may have different shapes, such as an inclined plane, an upward concavity in longitudinal section parallel to the direction of water flow, a longitudinal section comprised of upward concavity transitioning to an upward convexity, or combinations of straight, concave and convex sections. The ride surface incline 120 is desirably of sufficient length, width, and slope to enable a rider to perform manoeuvres thereon.

Figure 2:
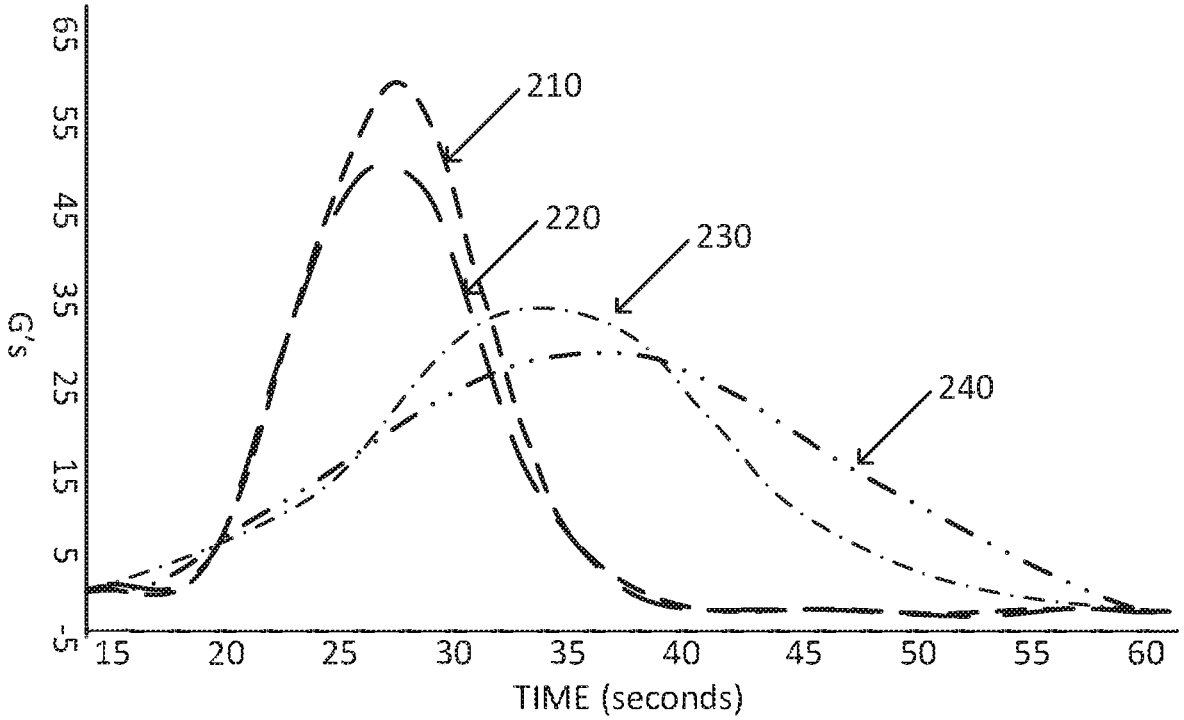
FIG. 2 illustrates a comparison of impact forces of conventional water ride apparatus systems.

FIG. 2 illustrates exemplary acceleration results over time experienced upon impact with conventional ride surface from a 45.4 inch drop height. In an effort to improve rider safety, different ride surfaces have been proposed. For example, hard surface may be covered in a foam enclosed in vinyl. The foam acts as a cushion for a rider during an impact. A first drop test 210 and a second drop test 220 over time generates over 45 Gs to decelerate the dropped object. A third drop test 230 with a ride surface formed by a tensioned layer provides a ride surface that is flexible and has an amount of flexibility and elasticity, such that the rider does not impact a complete rigid and hard surface. Such a flexible ride surface still imposes over 30 Gs upon impact to decelerate in a 45.5 inch drop test. A fourth drop test 240 for a ride surface formed by an inflatable layer also provide a flexible surface upon impact. The inflatable layer provides reduced deceleration as compared to the tensioned layer but still create over 25 Gs to decelerate. Thus, it will be appreciated upon review of FIG. 2 that the impact force and the impact duration experienced by a rider when hitting a ride surface both influence rider safety. To improve rider safety, it is desirable to minimize the force and the duration over which a rider experiences the force. From the results in FIG. 2, the ride surface formed from an inflatable layer yields the best result for the rider.

Figure 3:
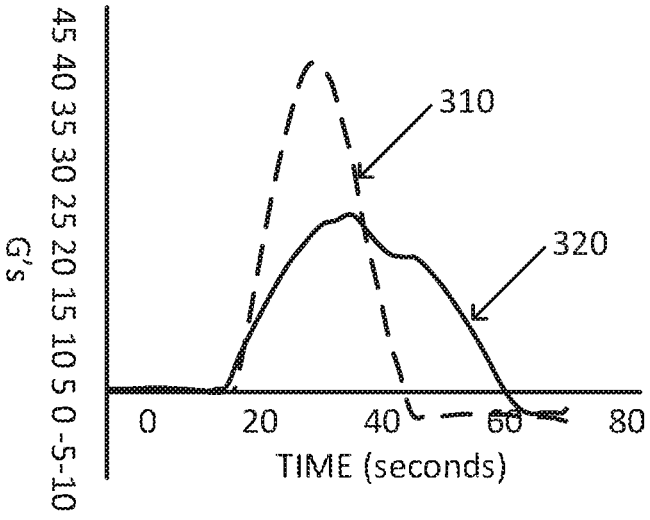
FIG. 3 illustrates a comparison of impact forces of embodiments of the water ride apparatus described herein.

FIG. 3 illustrates an exemplary comparison of the deceleration over time experienced in an exemplary drop test upon impact with an inflatable ride surface positioned on top of concrete. A first surface drop test 310 for an inflatable surface on concrete and a second surface drop test 320) for a combination of a tensioned surface and an inflatable surface. The drop in the forces imposed on the object shown are substantially an unexpected improvement when a combination of a first inflatable layer and a tensioned layer are used. Not only does the combination of the tensioned layer with the inflatable layer reduce the impact forces beyond those available for either of the inflatable layer alone or the tensioned layer alone, the time duration to decelerate is also increased. As will be appreciated by those skilled in the art, the duration of time to decelerate also has a substantial impact on whether a rider sustains injury during a collision. Additionally, it will be noted that the combination of the tensioned layer with an inflatable layer are surprisingly better than a ride surface comprising a first inflatable layer a second inflatable layer.

In reviewing the information from FIG. 2, a person of skill in the art would understand that a ride surface comprising an inflatable layer performs better than a ride surface comprising a tensioned layer. Therefore, the expectation would be that a ride surface comprising a combination of an inflatable layer with a second inflatable layer would perform better even better than a ride surface comprising a single inflatable layer or a combination of a single inflatable layer with a tensioned layer. When an inflatable layer is positioned over another inflatable layer, the resulting combination still results in the deceleration still experiencing over 25 Gs.

Conventionally, rider surfaces and amusement rides were very large construction projects that require large expenditures to build and implement. Therefore, further complicating these systems was not desired. It was also presumed that the combination of different solutions to reduce the deceleration forces experienced by a rider would not greatly improve by combining the solutions together. For example, a ride surface comprising a combination of an inflatable layer and a tensioned layer was not expected to result in improvements that would be much better than the 25 Gs already achievable by implementing a single solution of either the tensioned layer or the inflatable layer. It was believed that the benefits of one solution would minimize the effects of another solution. For example, if an inflatable layer were used over a tensioned layer, the expectation was that impact would first be effected by the inflatable layer before it was influenced by the tensioned layer. By the time the tensioned layer reacted to the impact, much of the impact forces would already be dissipated by the inflatable layer. As such, the combination was not expected to produce results any better than the individual results achieved by either structure. Consequently, it was not believed that the inclusion of both solutions within the same ride would justify the extra cost and complexity.

Surprisingly, the combination of an inflatable layer over a tensioned layer produced unexpected and substantially improved reductions in the forces experienced upon impact. As seen in FIG. 3, the inflatable layer experiences impacts deceleration of over 35 G's while the inflatable layer in combination with the tensioned layer only experiences deceleration of around 21 Gs. In addition, the duration to decelerate the object during the impact was increased. As such, a ride surface comprising a combination of the tensioned layer supporting an inflatable layer greatly improves the safety of a rider.

Conventional solutions have provided sufficient impact reduction to limit injury to avoid the added cost and complexity as contemplated herein. The cruise ship provides an environment that adds its own complexity, however. The cruise ship environment not only creates the traditional impact considerations as a conventional sheet wave water attraction, it also adds additional impact effects through the pitch and roll of the ship itself Therefore, an attraction on the cruise ship can create additional impact forces not experienced in a stationary ride positioned on the ground. The effects of the cruise ship on the water attraction is continuously felt, even when a rider is not suffering from a fall or other impact condition. Therefore, the ride surface of the water attraction on a cruise ship benefits from an improved structure support and stability. Exemplary embodiments described herein, including the ride surface that is a combination of a tensioned layer with an inflatable layer, provides sufficient stability and support for the cruise ship environment. Although embodiments described herein are well suited for a cruise ship environment or other dynamic environment, embodiments described herein may be used in any environment including conventional land based environments.

Figure 4:
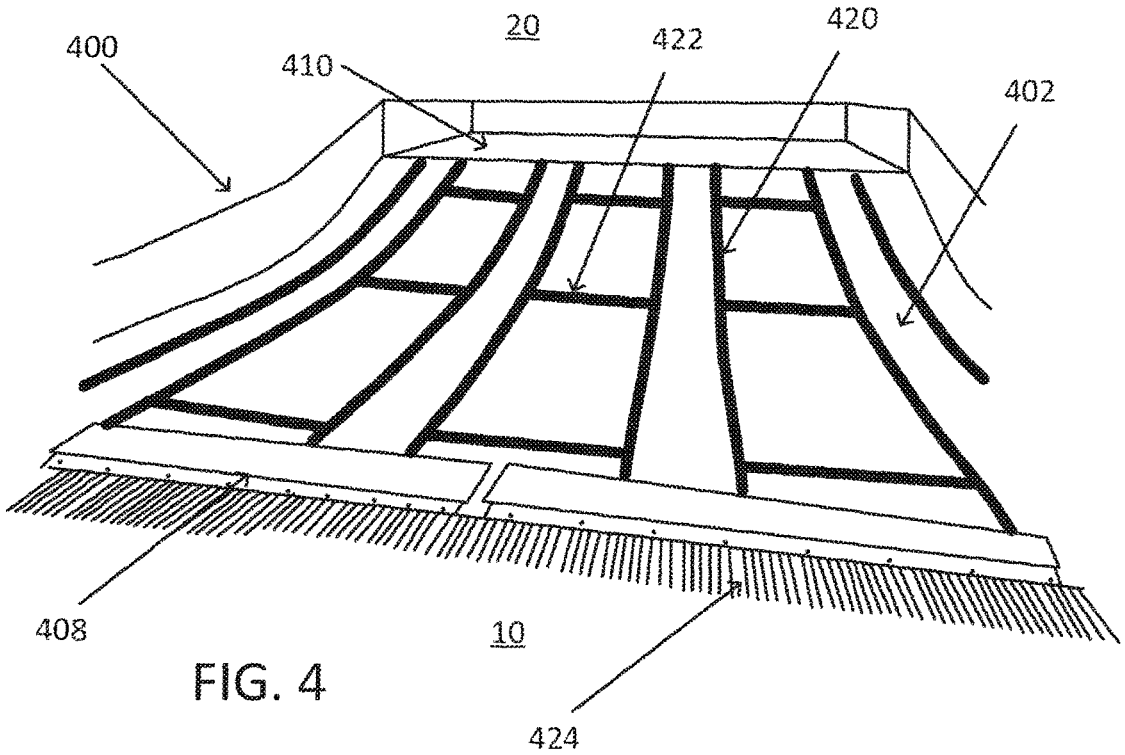
FIGS. 4-8 illustrate exemplary partial component views of the water ride apparatus according to embodiments described herein.

Turning now to FIG. 4, an exemplary partial ride surface of a water ride apparatus is illustrated. The partial ride surface comprises component parts of a water ride apparatus according to embodiments described herein. The amusement ride may include a first water drainage area 424 and a second water drainage area 410 positioned at a front end 10 and/or the back end 20 of the water ride apparatus 400. The first water drainage area 424 and the second water drainage 410 are configured to remove water from the ride surface. The water drainage areas 410, 424 may also include a grate or surface with apertures for passing water there through. The front end 10 of the water ride apparatus may also include a water injection system such as one or more nozzles positioned at or along the front end 10 of the ride. The front end 10 of the water ride apparatus may also include a nozzle flap 408 positioned over the one or more nozzles of the water injection system.

Figure 5:
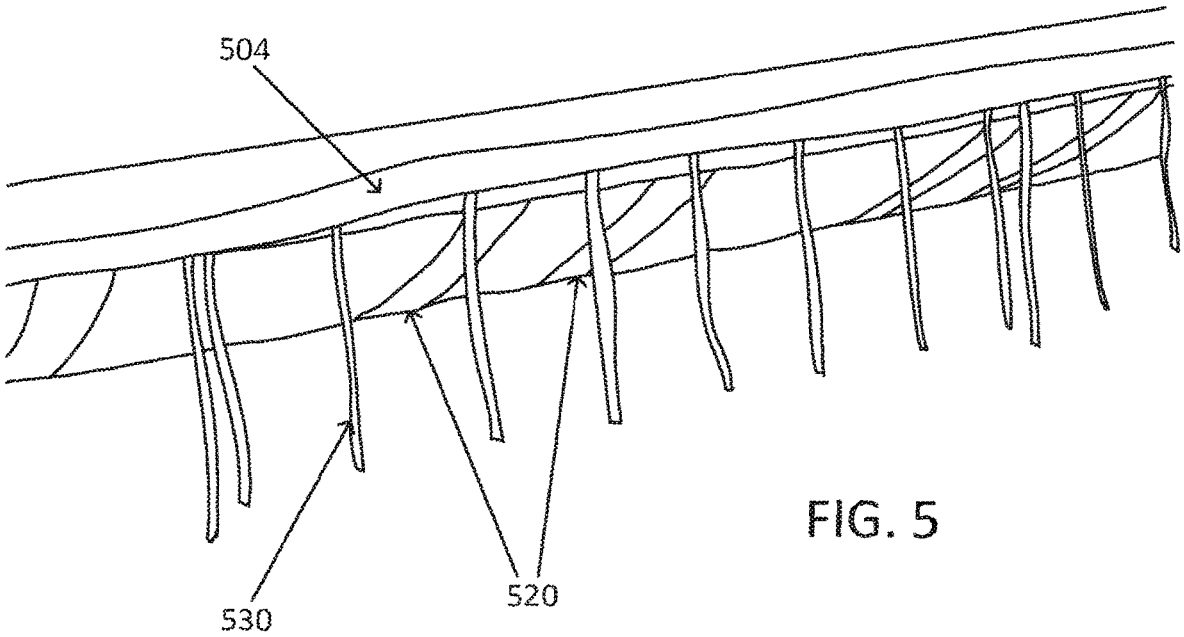

The top side of the tensioned layer 402 may include one or more elongated fasteners 420, 422 for coupling to the inflatable layer, such as the inflatable layer illustrated in FIG. 5. The one or more elongated fasteners 420, 422 may include one side of a hook and loop fastener that mates with the corresponding side of the hook and loop fastener. The one or more elongated fasteners 420, 422 may also be configured to assist in the retention of the inflatable layer to the tensioned layer and/or may assist in the alignment of the inflatable layer with the tensioned layer. Additionally, the one or more elongated fastener 420, 422 may include elongated sections that create a pattern. The pattern, as illustrated may include one or more elongated fasteners in a first direction and one or more elongated fasteners in a second direction. The first and second directions may be perpendicular to each other as illustrated. The one or more elongated fasteners 420, 422 may create a grid pattern to assist in alignment in different directions. As illustrated, a first set of one or more elongated fasteners 420 extend from adjacent the water injection system (under nozzle flap 408) to the rear of the ride toward the rear water drainage area 410. The first set of one or more elongated fasteners 420 may be generally parallel to the direction of water injection. The second set of one or more elongated fasteners 422 may be generally perpendicular to the first set of one or more elongated fasteners 420 and/or to the direction of water flow. The inflatable layer can be coupled to the tensioned material through a hook and loop fastener. The hook and loop fasteners may be positioned in a pattern, the pattern may have components perpendicular to each other.

FIG. 5 illustrates a bottom perspective, partial view of an inflatable layer 504. The bottom side of the inflatable layer 504 may include one or more fasteners 520, 530 for coupling the inflatable layer 504 to the water ride apparatus. The one or more fasteners 520, 530 may include one or more ties 530. The one or more ties 530 may extend through or around another portion of the amusement ride. For example, the one or more ties 530 may be on a bottom side of the inflatable layer 504 engaging a rear portion of the ride to couple to the water drainage area, such as drainage area 410 in FIG. 4 on a back end 20 of the ride surface. The one or more ties 530 may extend through one or more corresponding apertures configured for drainage and couple together to retain the inflatable layer 504 at a back end of the ride surface. The one or more fasteners 520 may couple to other support structures as well. The one or more fasteners 520 may also include the corresponding or mated pair of a hook and loop fastener as shown and described with respect to FIG. 4 on the top of the tensioned layer. The inflatable layer 504 may include a plurality of elongated fasteners for coupling to a water drainage of the water collection system. The water drainage area may include a cover that has apertures for passing water there through. The water drainage area may also include a grid for supporting a rider while permitting water to pass.

Figure 6:
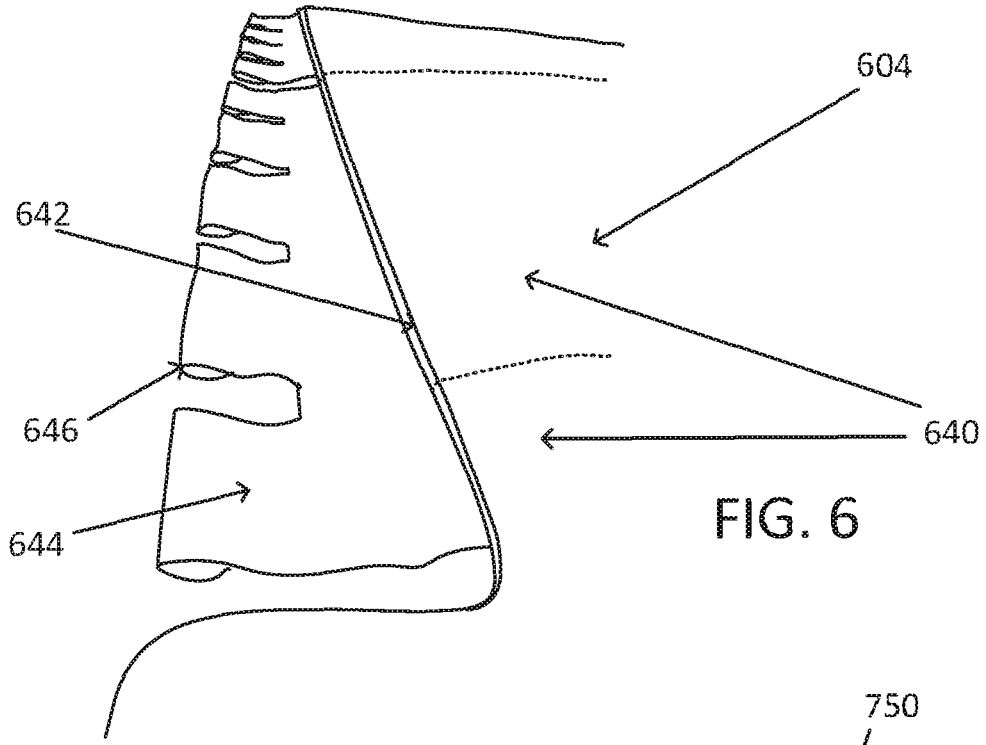

In an exemplary embodiment, the inflatable layer is anchored to the water ride apparatus adjacent the water injection system. FIG. 6 illustrates a partial view of the inflatable layer 604. The inflatable layer may include a plurality of separate bladders 640 positioned adjacent one another. The plurality of separate bladders 640 may include a ride cover 642. The ride cover 642 may alternatively be positioned over a single bladder defining the inflatable layer. The inflatable layer 604 may include a plurality of individual bladders 640 covered by a ride cover 642. The ride cover 642 may extend past an edge of the inflatable layer (such as the edge of the plurality of individual bladders) to create a projection extending from a side of the inflatable layer. The projection may create a fastener for coupling to a support structure of the water ride apparatus. As illustrated, the extension comprises gaps such that the extension is defined by a plurality of projections 644 with gaps between adjacent projections. Each of the plurality of projections 644 may include a loop 646. The loop 646 may be configured to retain the inflatable layer 604 to the ride support structure 706 (FIG. 7).

Figure 7:
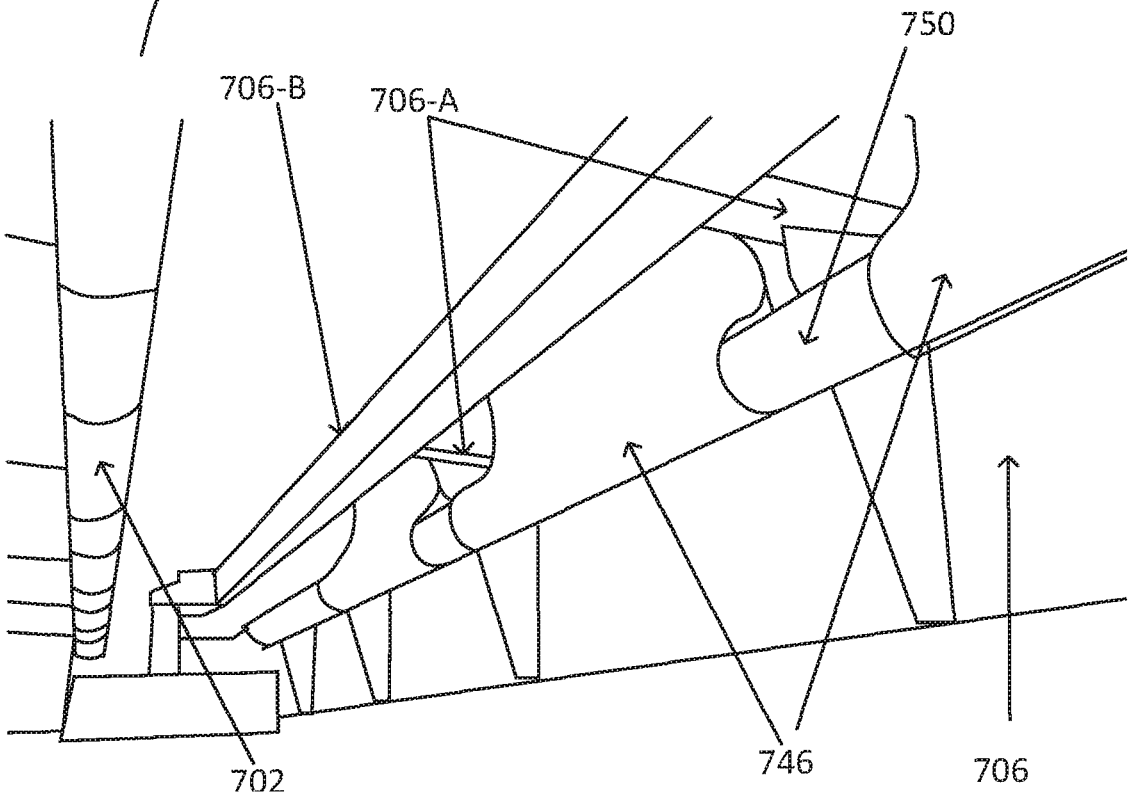

FIG. 7 illustrates a partial perspective view of an underside of the water ride apparatus including the support structure 706. The support structure 706 may include one or more beams 706-A, 706-B for supporting the tensioned layer 702 and/or base or water attraction. The support structure 706 may also include walls for retaining water under the tensioned layer 702. As illustrated, the projections 746 (or extensions) extending from an end of the inflatable layer extend through the spaces created by the one or more beams 706-A of the support structure coupled to one or more cross-beams 706-B. The gaps between projections 746 permit the support beams 706-A to be positioned therein. Accordingly, the coupling to the support structure 706 may include beams of the support structure 706 positioned within the gaps between adjacent projections 746 of the ride surface. As illustrated, a rod 750 may be positioned within each of the loops of the plurality of projections 746 to maintain the inflatable layer in a desired position relative to the support structure.

Figure 8:
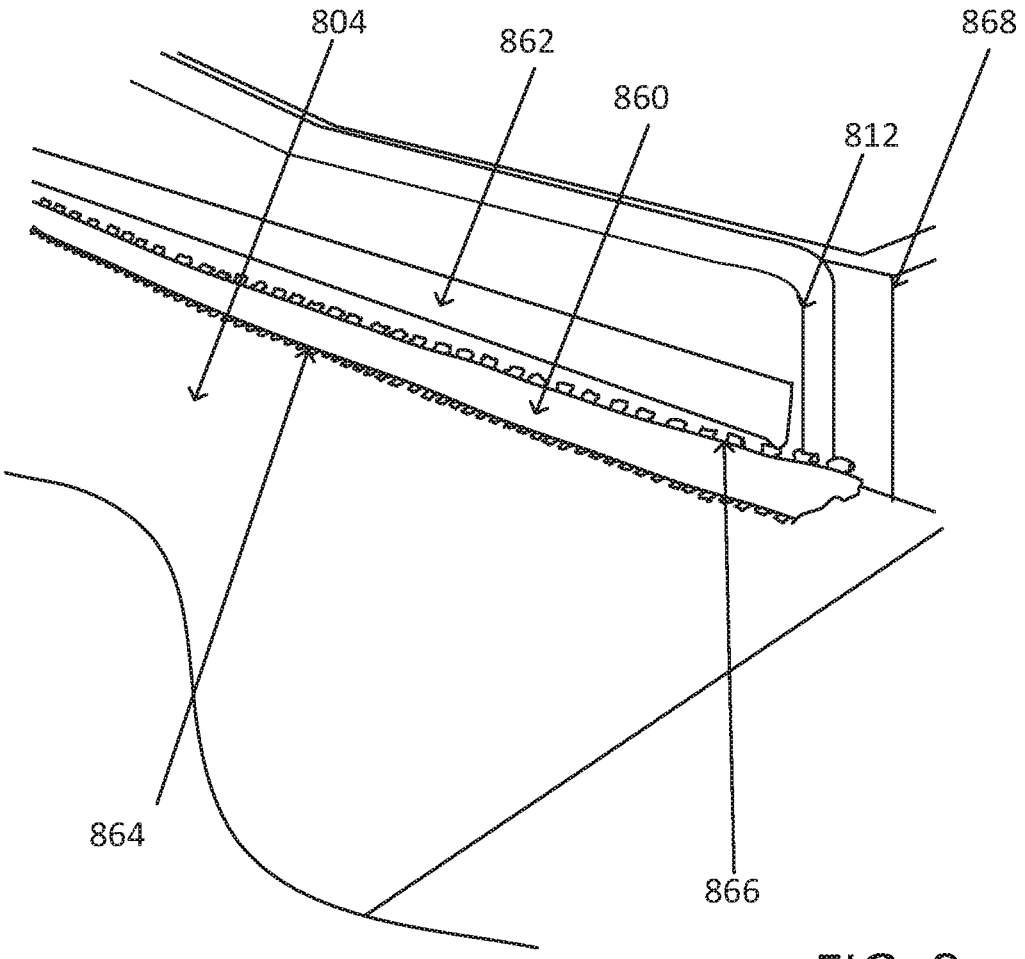

FIG. 8 illustrates a partial view of the side of the water ride apparatus in which the inflatable layer 804 is coupled to the inflatable wall 812. The water ride apparatus may include an inflatable side wall(s) 812 positioned on top of the tensioned layer and between the inflatable layer 804 and a hard wall 868 of the water ride apparatus. The inflation pressures of the inflatable layer and the inflatable wall 812 may frictionally engaged and retain the inflatable wall and inflatable layer in a desired position between rigid opposing hard walls 868.

In an exemplary embodiment, the inflatable wall 812 and/or surface 804 (either the inflatable layer or tensioned layer) may include fasteners for coupling the respective inflatables together. For example, the inflatable layer or tensioned layer may include ride surface fastener 860. The fastener may include ties 864, 866. The inflatable wall 812 may also include flap 862 with corresponding ride surface fastener 860. The ride surface fastener 860 of flap 862 may couple to tie 866. In an exemplary embodiment, loops are provided for tying the respective surfaces together. As illustrated, tie 866 of surface 804 may include two rows of ties 864, 866. The fastener may be used to couple inflatable layer and/or inflatable wall 812 or other system components. The ride surface fastener 860 may be positioned on tensioned layer for coupling the inflatable wall and the inflatable layer and/or may be positioned on an inflatable ride surface for coupling to the inflatable wall and/or adjacent inflatable layers and/or tensioned layer and/or ride surfaces. In an exemplary embodiment, the inflatable side wall is coupled to the inflatable layer by ties.

In an exemplary embodiment, the inflatable layer is inflated to a pressure of from about 8-10. In an exemplary embodiment, the tensioned layer is under force of about 60 g/mm. In an exemplary embodiment, the inflatable side wall is inflated to a pressure of from about 1-3 psi.

In an exemplary embodiment, the ride surface may be created from an inflatable sheet positioned over the tensioned membrane. The inflatable sheet conforms to the shape created by the tensioned membrane. The inflatable sheet may be coupled to the tensioned membrane. For example, the two surfaces may be coupled using a hook and loop fastener, such as Velcro® to secure the surfaces together. Other attachment methods are also contemplated, such as adhesive, hook and loop, attachments, or other coupling devices. The inflatable layer may also be secured to the front of the ride structure through structural supports. For example, the tensioned layer and/or the inflatable layer may be secured to the front steel supports by using a pipe to hook under the nozzle. In an exemplary embodiment, a plurality of attachment mechanisms may be disposed in the base, inflatable sheet, tensioned layer, tensioned layer frame, and/or beams that are configured to connect with a plurality of stabilizing elements to position the component parts in a desired position relative to each other or retain a position of a component part when under pressure of the rider and/or injected water during use.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A water ride apparatus, comprising:

a ride surface configured to support a sheet of water on an upper surface thereof, the ride surface comprising:

a tensioned layer having a tensioned material coupled to a tension framework, the tension framework comprising a support structure including tensioning elements configured to impose a tension force onto the tensioned material such that the tensioned layer defines a ride shape and provides support and shape characteristics for the ride surface; and an inflatable layer comprising an inflatable sheet positioned over and coupled to the tensioned layer;

wherein the inflatable layer has an upper surface defining a ride-supporting portion over which the sheet of water travels, and wherein the tensioned layer is positioned below the inflatable layer and provides support to at least a majority of the inflatable layer;

a water injection system for injecting water onto the ride surface; and a water collection system for removing the injected water from the ride surface, wherein the inflatable layer substantially conforms to the ride shape defined by the tensioned layer.

2. The water ride apparatus of claim 1, wherein the inflatable layer is secured to the water injection system.

3. The water ride apparatus of claim 1, wherein the inflatable layer has a substantially constant thickness across the ride-supporting portion such that the ride shape of the upper surface of the inflatable layer substantially conforms to the ride shape defined by the tensioned layer.

4. The water ride apparatus of claim 1, wherein the inflatable layer is inflated to a pressure of 8 to 10 psi.

5. The water ride apparatus of claim 1, wherein the ride surface comprises a plurality of ride surface layers integrally formed to operate as the ride surface, and wherein the ride surface layers include a first ride surface layer and a second ride surface layer positioned adjacent to the first ride surface layer, and wherein the first ride surface layer includes the tensioned layer, and wherein the second ride surface layer includes the inflatable layer.

6. The water ride apparatus of claim 1, wherein the inflatable layer comprises a sloped surface configured to vary in one or more directions, and wherein the inflatable layer is separate from the tensioned layer.

7. The water ride apparatus of claim 1, wherein the inflatable layer is formed from drop-stitch manufactured panels.

8. The water ride apparatus of claim 1, wherein the ride surface comprising the tensioned layer and the inflatable layer is configured to reduce deceleration forces experienced during rider impact and to increase deceleration duration relative to a ride surface comprising only the tensioned layer or a ride surface comprising only the inflatable layer.

9. The water ride apparatus of claim 1, further comprising an inflatable bladder for altering the ride shape.

10. The water ride apparatus of claim 9, wherein the inflatable bladder is positioned between the tensioned layer and the inflatable layer.

11. The water ride apparatus of claim 1, wherein the inflatable layer is coupled to the tensioned material through a hook and loop fastener.

12. The water ride apparatus of claim 11, wherein the hook and loop fasteners are positioned in a pattern, the pattern having components perpendicular to each other.

13. The water ride apparatus of claim 11, wherein the inflatable layer comprises a plurality of elongated fasteners for coupling to a grid covering the water collection system.

14. The water ride apparatus of claim 1, further comprising inflatable side walls positioned on top of the tensioned layer and between the inflatable layer and a hard wall of the water ride apparatus.

15. The water ride apparatus of claim 14, wherein the inflatable side walls are inflated to a pressure of 1 to 3 psi.

16. The water ride apparatus of claim 14, wherein the inflatable side walls are coupled to the inflatable layer by ties.

17. The water ride apparatus of claim 1, wherein the inflatable layer comprises a plurality of individual bladders.

18. The water ride apparatus of claim 17, wherein the ride surface extends past an edge of the plurality of bladders of the inflatable layer to define a projection extending from a side of the inflatable layer, the projection defining a fastener for coupling to a support structure of the water ride apparatus.

19. The water ride apparatus of claim 18, wherein the projection comprises gaps such that the projection is defined by a plurality of extensions and each of the plurality of extensions comprises a loop and the coupling to the support structure comprises beams of the support structure positioned within the gaps and a rod positioned within each of the loops of the plurality of extensions.

20. A method of reducing a force of a surface on a rider for a water ride apparatus, comprising:

providing a ride surface configured to support a sheet of water on an upper surface thereof, the ride surface comprising a tensioned layer having a tensioned material coupled to a tension framework, the tension framework comprising a support structure including tensioning elements configured to impose a tension force onto the tensioned material such that the tensioned layer defines a ride shape and provides support and shape characteristics for the ride surface; and an inflatable layer comprising an inflatable sheet positioned over and coupled to the tensioned layer;

wherein the inflatable layer has an upper surface defining a ride-supporting portion over which the sheet of water travels, and wherein the tensioned layer is positioned below the inflatable layer and provides support to at least a majority of the inflatable layer;

securing the inflatable layer to an upper surface of the tensioned layer;

providing a water injection system in communication with the ride surface; and providing a water collection system for removing the injected water from the ride surface, wherein the inflatable layer substantially conforms to the ride shape defined by the tensioned layer.

* * * * *